US006190184B1

(12) United States Patent
Cimbal et al.

(10) Patent No.: US 6,190,184 B1
(45) **Date of Patent: *Feb. 20, 2001**

(54) CONNECTOR FOR ELECTRIC APPLIANCES

(75) Inventors: Jochen Cimbal, Friedberg; Thomas Schamberg, Usingen; Helmut Dürr, Kriftel, all of (DE)

(73) Assignee: Braun Aktiengesellschaft, Frankfurt am Main (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/041,924

(22) Filed: Mar. 13, 1998

Related U.S. Application Data

(63) Continuation of application No. PCT/EP96/02726, filed on Jun. 24, 1996.

(30) Foreign Application Priority Data

Oct. 28, 1995 (DE) ..... 195 40 304

(51) Int. Cl.[7] ..... H01R 13/60; H01R 29/00

(52) U.S. Cl. ..... 439/131; 439/172

(58) Field of Search ..... 439/131, 172, 439/174, 171, 52, 104

(56) References Cited

U.S. PATENT DOCUMENTS

| | | | | |
|---|---|---|---|---|
| 2,323,736 | * | 7/1943 | Tousley | 173/361 |
| 4,078,848 | * | 3/1978 | Blairsdale | 339/14 P |
| 4,997,381 | * | 3/1991 | Oh | 439/172 |
| 5,401,178 | * | 3/1995 | Liu | 439/131 |
| 5,576,911 | * | 11/1996 | Porter | 360/98.06 |
| 5,628,641 | * | 5/1997 | Hahn | 439/131 |
| 5,713,749 | * | 2/1998 | Wu | 439/131 |
| 5,829,993 | * | 11/1998 | Wu | 439/131 |

FOREIGN PATENT DOCUMENTS

| | | | | |
|---|---|---|---|---|
| 678 794 | | 9/1966 | (BE) . | |
| 678794 | * | 9/1966 | (BE) . | |
| 371548 | | 3/1921 | (DE) . | |
| 83 29 691 | | 1/1984 | (DE) . | |
| 35 35 564 | | 5/1986 | (DE) . | |
| 3535564 | * | 5/1986 | (DE) | H01R/27/00 |
| 42 13 115 | | 10/1993 | (DE) . | |
| 57-061272 | | 4/1982 | (JP) . | |
| 57-061273 | | 4/1982 | (JP) . | |
| 60-39390 | | 9/1985 | (JP) . | |

* cited by examiner

*Primary Examiner*—Brian Sircus
*Assistant Examiner*—Chandrika Prasad
(74) *Attorney, Agent, or Firm*—Fish & Richardson P.C.

(57) ABSTRACT

The invention is directed to an electric appliance for personal use such as a dry shaving apparatus, a hair cutting machine or epilator, having a housing to accommodate an electric motor, a storage cell charging circuitry, at least one rechargeable storage cell designed to be connected to the electric motor, and a connector compartment in which a connector equipped with connector pins is pivotally mounted, wherein the connector pins are movably carried in a connector housing surrounding the connector pins, wherein the connector housing with the connector pins therein is arranged for pivotal movement out of and into the connector compartment, and wherein, with the connector in a position in which it is pivoted out of one of the broad sides of the housing, provision is made for the connector pins arranged side by side parallel to said broad side to be movable out of and into the connector housing by means of an actuating element movably disposed in the interior of the connector housing.

22 Claims, 9 Drawing Sheets

CONNECTOR FOR ELECTRIC APPLIANCES

This application is a continuation of International Application No. PCT/EP96/02726 filed Jun. 24, 1996 claiming priority from German Patent application No. 19540304.5 filed Oct. 28, 1995.

BACKGROUND OF THE INVENTION

This invention relates to an electric appliance for personal use such as a dry shaving apparatus, a hair cutting machine or epilator, having a housing to accommodate an electric motor, a storage cell charging circuitry, at least one rechargeable storage cell designed to be connected to the electric motor, and a connector compartment in which a connector equipped with connector pins is pivotally mounted.

An electric appliance with a connector designed to be pivoted out of a connector compartment is known from Japanese patent publication 60-39390 B2. The connector comprises a connector housing and two leaf-shaped connector pins projecting from the connector housing.

From U.S. Pat. No. 4,997,381 there is known an electric appliance with a connector designed to be pivoted out of one of the broad sides of the housing, the two leaf-shaped connector pins being pivotally arranged in the connector housing, and the two round connector pins being fastened in extension of the connector housing to the connector housing. Inside the housing of the electric appliance is a connector compartment, and in an extension of the latter are two elongate recesses to accommodate the connector with the two round connector pins projecting therefrom.

From DE 35 35 564 C2 there is known an electric appliance with a connector housing designed to be pivoted out of one of the narrow sides of the housing of the electric appliance. The two round connector pins, which are slidably arranged within the pivotal connector housing, are associated with an actuating device with a connector pin pusher, which is retractably mounted in the housing of the electric appliance. When the connector housing is pivoted out, the connector pin pusher lies in the extension of the connector housing and is pushed into the connector housing in order to push the connector pins out of the connector housing into an operating position.

From German utility model G 83 29 691 (U1) there is known an arrangement in which the connector of a rechargeable shaving apparatus is slidably positioned at one end of the shaver housing so that the two leaf-shaped connector pins fastened to a connector housing are pushed out of one of the two narrow sides of the shaver's housing by means of an actuator switch arranged in the bottom of the housing in order to make the connection to a socket-outlet of a voltage source. To ensure that the connector pins projecting out of the shaver's housing sit securely and in particular do not wobble it is necessary to provide a suitable guide, a relatively long support section for the connector housing fixedly connected to the connector pins inside the shaver's housing, and the additional arrangement of a buffer. The amount of space required by such a connector construction is therefore considerable.

Electric appliances of the type initially referred to are known to be equipped with various connectors in conformance with various standards, e.g. connectors with relatively close lying leaf-shaped connector pins for 110 volts/125 volts or round connector pins for 220 volts, 230 volts/240 volts, which compared with the leaf-shaped connector pins are spaced further apart because of the higher voltage involved. The spacing to be observed for round connector pins to conform with applicable standards makes it impossible to replace leaf-shaped connector pins with round connector pins, for example, on the known arrangement of the connector arranged to be pivoted out of a broad side of the shaver's housing according to FIG. 18 of Japanese patent publication 60-39390 (B2) on account of the relatively slim shaver housing.

SUMMARY OF THE INVENTION

It is an object of the present invention to create an electric appliance of the type initially referred to, in which the arrangement of a connector with connector pins inside the housing of the electric appliance is assured in minimum space.

It is intended furthermore to simplify the manipulation of an electric appliance equipped with a connector.

According to the present invention, this object is accomplished by the combination of features specified in claim 1.

The ability to pivot the connector out of a connector compartment provided in one of the broad sides of the housing of an electric appliance results, in conjunction with the connector pins which are arranged side by side parallel to this broad side and are movably mounted inside the connector housing and with an actuating element likewise movably arranged inside the connector housing, in compact and relatively small overall dimensions for a connector equipped with round connector pins. That section of the connector housing which on a connector of this type necessarily projects out of the housing of the electric appliance in order to connect with a live electric socket-outlet is used advantageously in conjunction with that part of the connector extending into the housing of the electric appliance in order to accommodate the round connector pins.

According to a preferred embodiment of the present invention, provision is made inside the connector housing for at least one locking position for the connector pins. In a further aspect of this embodiment, the connector pins are held inside the connector housing in a locking position in order, for example, to prevent rattling noises while transporting the electric appliance or obstructions by the connector pins while pivoting the connector housing in and out of the connector compartment. In yet another aspect of the two previously mentioned embodiments of the present invention, provision is made for the connector pins to be held outside the connector housing in a locking position. This embodiment of the invention makes it easier to connect the connector to a live electric socket-outlet.

To make it easier for the user to move the connector pins out of the connector housing into an operating position, the connector pins are adapted to be acted upon by at least one spring. According to an embodiment of the present invention that is particularly easy to manufacture, the spring is arranged between a rear wall of the connector housing and a connector pin pusher fixedly connected to the connector pins. In a further aspect of this embodiment, provision is made for an actuating element for moving the connector pin pusher from one locking position into a further locking position and back again. In a further aspect of this embodiment, provision is made for the actuating element to be held by a spring in the respective locking position.

To hold the connector in its non-operating position on the one hand, that is, inside the connector compartment, and in its operating position on the other hand, that is, pivoted out of the connector compartment, in a further embodiment of the present invention the connector housing is equipped with at least one locking element, and for each locking element there are provided two latching elements on the housing in order to limit the pivoting movement of the connector out of and into the housing.

According to an embodiment of the present invention, the connector is preferably pivotally mounted in the connector compartment by means of two bearing pins. In a further aspect of this embodiment, the pivot bearing for the bearing pins is formed by corresponding semi-circular recesses in a first and a second shell of the housing.

To facilitate handling of the connector, provision is made in accordance with an embodiment of the invention for each of the two bearing pins to be positioned a certain distance from each end wall of the connector.

According to a preferred embodiment of the present invention, provision is made for each connector pin to be connectable to an electric contact of the storage cell charging circuitry via an electric contact while the connector is pivoted out of the connector compartment.

According to a preferred embodiment of the present invention, provision is made for the connector pins to be of a round configuration.

Owing to the fact that the distance between leaf-shaped connector pins is substantially smaller than the distance between round connector pins, provision is made in accordance with an alternative embodiment of the invention for the connector pins to be of a leaf-shaped configuration.

Handling the connector of the present invention is greatly simplified in accordance with a preferred embodiment in that the actuating element is movable in one locking position against an unlocking element provided in the housing.

In a further aspect of this embodiment, provision is made for the connector pins to be capable of being unlocked by means of the unlocking element acting on the actuating element when the connector housing is pivoted into the interior of the connector compartment.

The connector pins are preferably held by the spring in abutting engagement with a wall of the connector compartment.

A significant advantage of this embodiment is that the unlocked connector pins are moved by the spring automatically out of the connector housing into a locking position when the connector is pivoted into its operating position.

According to a further embodiment of the present invention, provision is made for the unlocking element to be positioned on a wall of the housing. Alternatively, yet further embodiments of the invention provide for the unlocking element to be positioned on a printed-circuit board in the housing. In a preferred embodiment of the present invention, unlocking the actuating element is facilitated by configuring the unlocking element as a protruding, rounded ledge.

Further advantages and details of the present invention will become apparent from the subsequent description and the accompanying drawing illustrating a preferred embodiment.

DETAILED DESCRIPTION OF THE INVENTION

Figure 1:
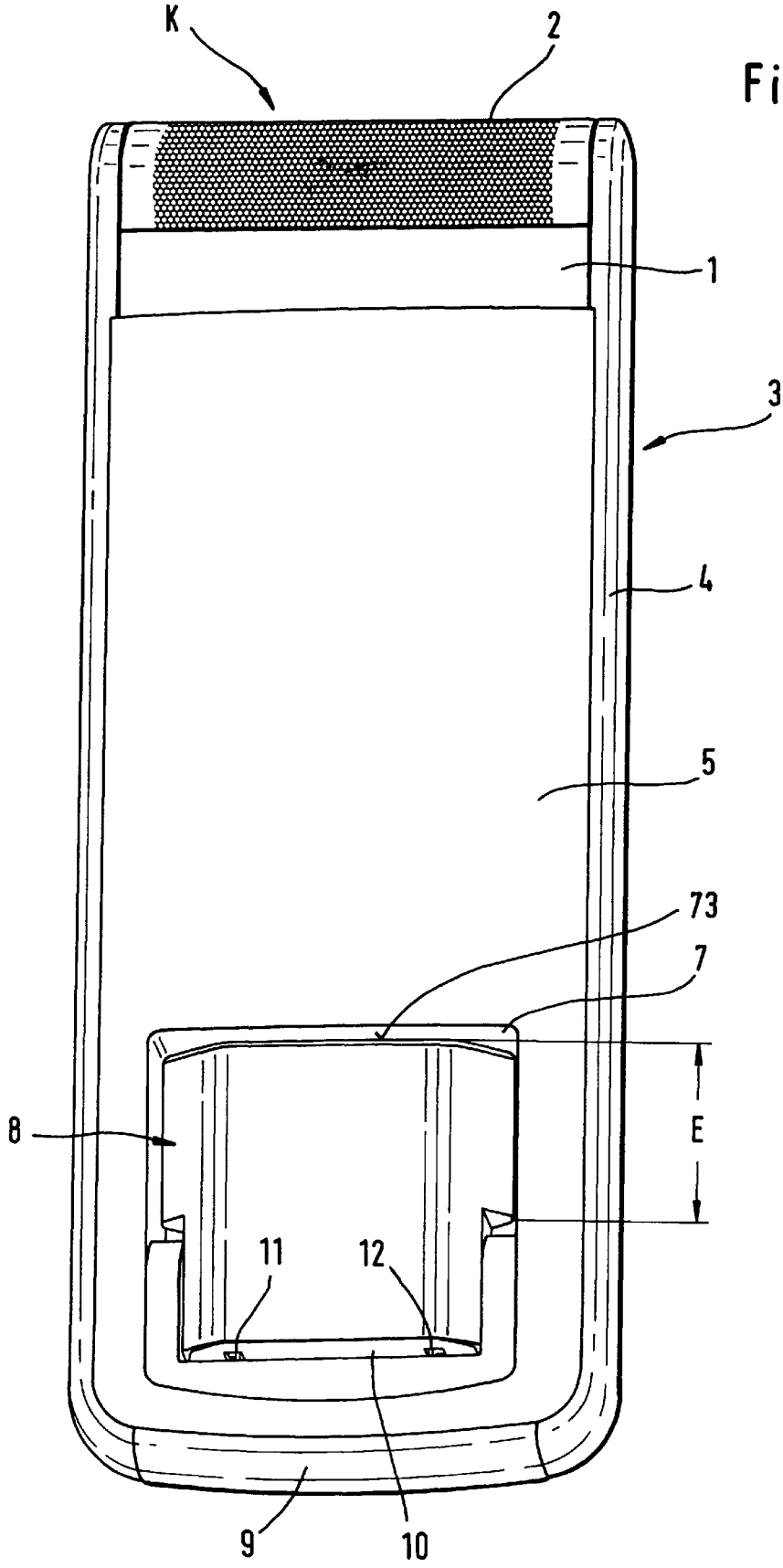
FIG. 1 is a view of a dry shaving apparatus with a shaving head and, at the bottom end, a connector compartment provided in a broad side of the housing with a connector inside.
Figure 2:
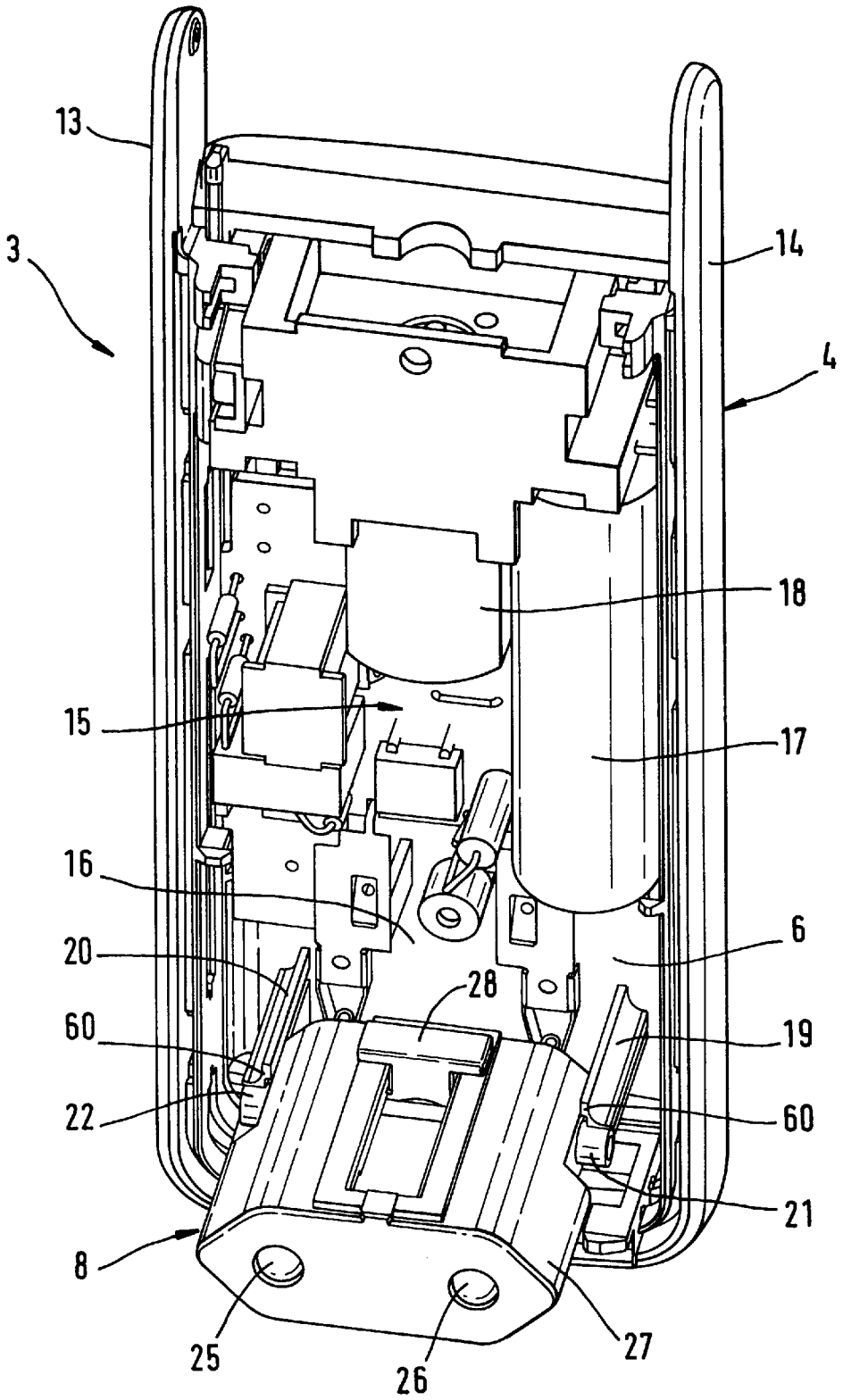
FIG. 2 is a perspective view of the housing of the dry shaving apparatus of FIG. 1 with a first housing shell removed, a connector pivoted into an operating position, and a storage cell charging circuitry with a storage cell and an electric motor.
Figure 3:
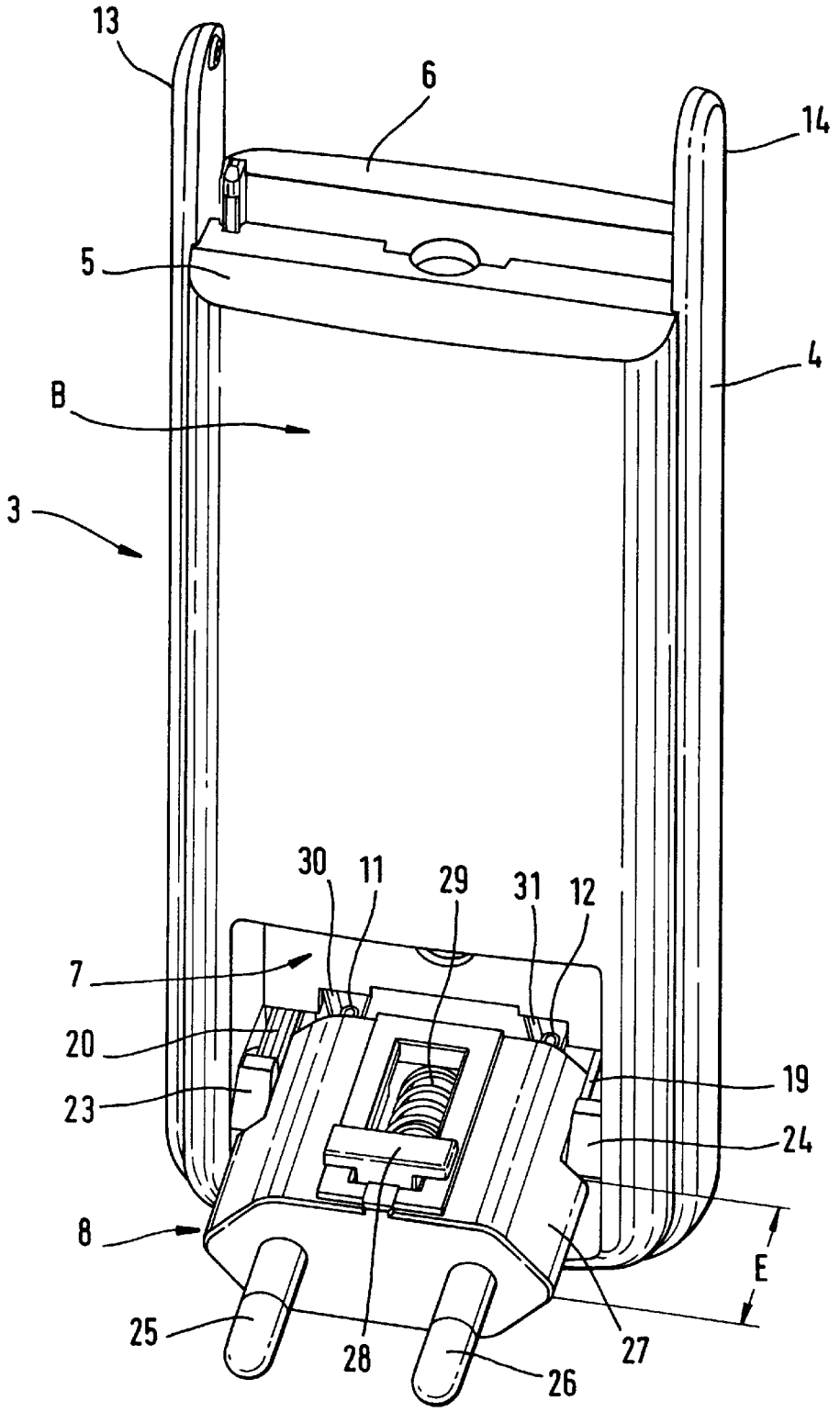
FIG. 3 is a view of a dry shaving apparatus of FIGS. 1 and 2 with a connector pivoted out of one of the broad sides of the housing with its connector pins projecting out of the connector housing.

FIG. 1 shows an electric appliance, namely an electric dry shaving apparatus with a short-hair cutter assembly K comprising an outer foil 2 secured in tension in an outer foil frame 1 and a housing 3 surrounding the shaver's electrical and mechanical drive elements, which is made up of a frame 4, a first housing shell 5 and a second housing shell 6 as shown in FIG. 3. The first housing shell contains at least one actuating element for switching the dry shaving apparatus on and off and a locking element for locking the actuating element in the off position—not shown. Opposite the short-hair cutter assembly K in the first housing shell 5 directly adjacent to the base wall 9 and extending into the interior of the housing 3 is a connector compartment 7 in which a connector 8 is mounted for pivotal movement around a pivot axis extending parallel to the base wall 9. Two pin contacts 11 and 12 are shown on the rear wall 10 of the connector 8 facing the base wall 9 of the housing 3. In the front wall 73 opposite the rear wall 10 are two openings for the connector pins 25, 26 to pass through—see FIG. 2.

Figure 9:
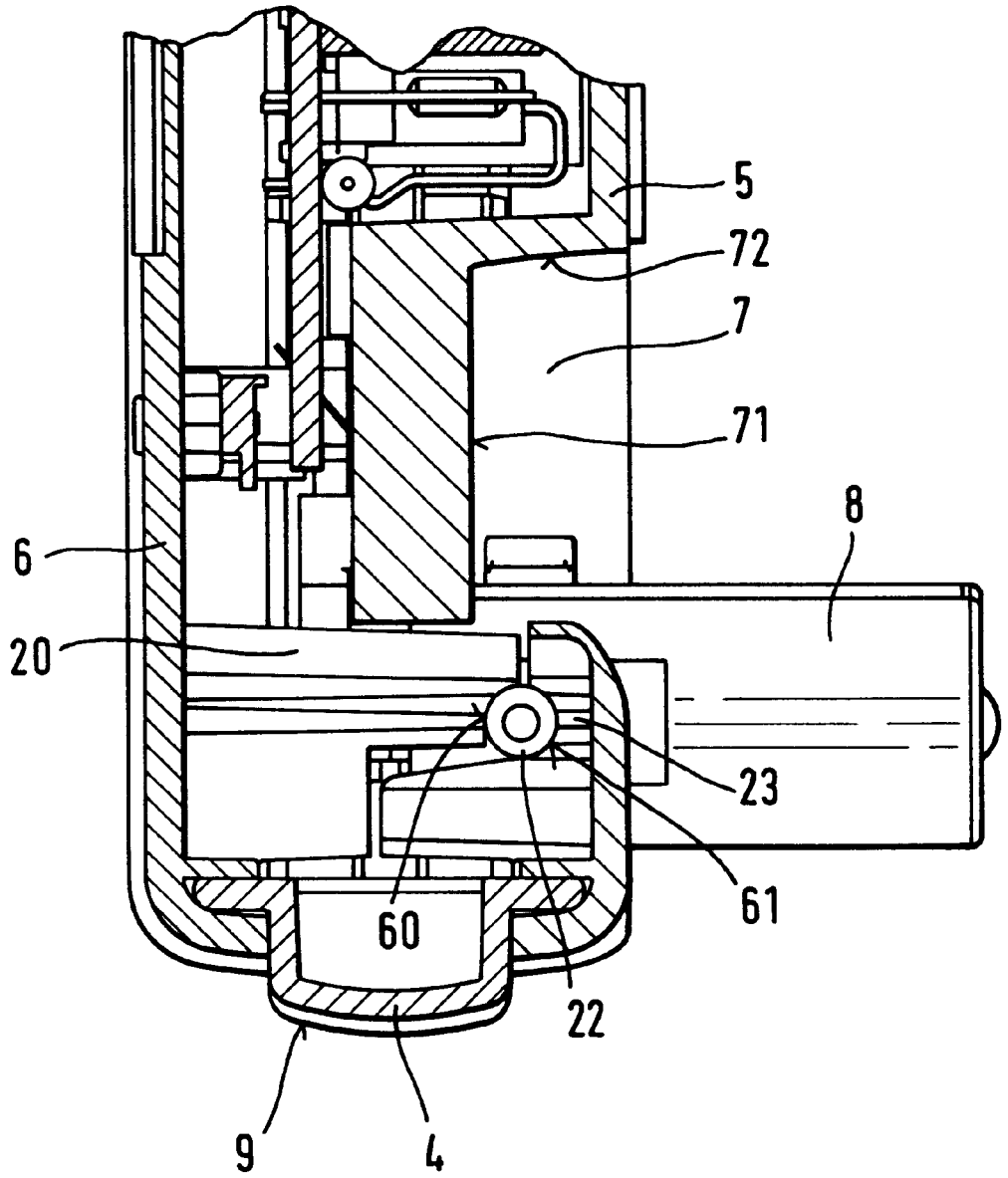
FIG. 9 is a sectional view of the bottom part of the housing, taken along the line T—T of FIG. 7.

FIG. 2 is a perspective view of the housing 3 of FIG. 1 showing the short-hair cutter assembly K removed and the first housing shell 5 also removed. Arranged between the two narrow end cheeks 13 and 14 of the frame 4 is a storage cell charging circuitry 15 on a printed-circuit board 16 including a storage cell 17. Adjacent to the storage cell 17 is an electric motor 18 in the housing 3 for driving a cutter blade of the dry shaver's short-hair cutter assembly. Two rear arms 19 and 20 are formed on the second housing shell 6 to support the connector 8 by means of two bearing pins 21 and 22. The bearing for the bearing pins 21 and 22 is formed by corresponding semicircular recesses 60, 61, which are provided in the front bearing arms 21 and 22 of the second housing shell 6 and in front bearing arms 23 and 24 provided on the first housing shell 5. Details of the bearing construction for the bearing pins 21 and 22 are shown in the sectional view of FIG. 9.

The embodiment of FIG. 2 shows the connector 8 pivoted out of the broad side of the housing 3 with an actuating element 28 in close proximity to the printed-circuit board 16 for moving the connector pins 25 and 26 out of the connector housing 27 into an operating position—see FIG. 3. The connector 8 is comprised of a connector housing 27 in which the connector pins 25 and 26 are accommodated over their full length.

FIG. 3 is a perspective view of the dry shaving apparatus of FIGS. 1 and 2 with a fully enclosed housing 3 formed by joining the first housing shell 5 and the second housing shell 6 to the frame 4. In the broad side B of the housing 3 the connector 8 is pivoted out of the connector compartment 7 formed in the first housing shell 5 into a position suitable for connection of the connector 8 to a socket-outlet not shown, in which position the connector pins 25, 26 are moved out of the connector housing 27 and locked in place by displacement of the actuating element 28 from the position shown in FIG. 2 toward the connector pins 25 and 26 into the position shown in FIG. 3—see FIG. 5.

Figure 6:
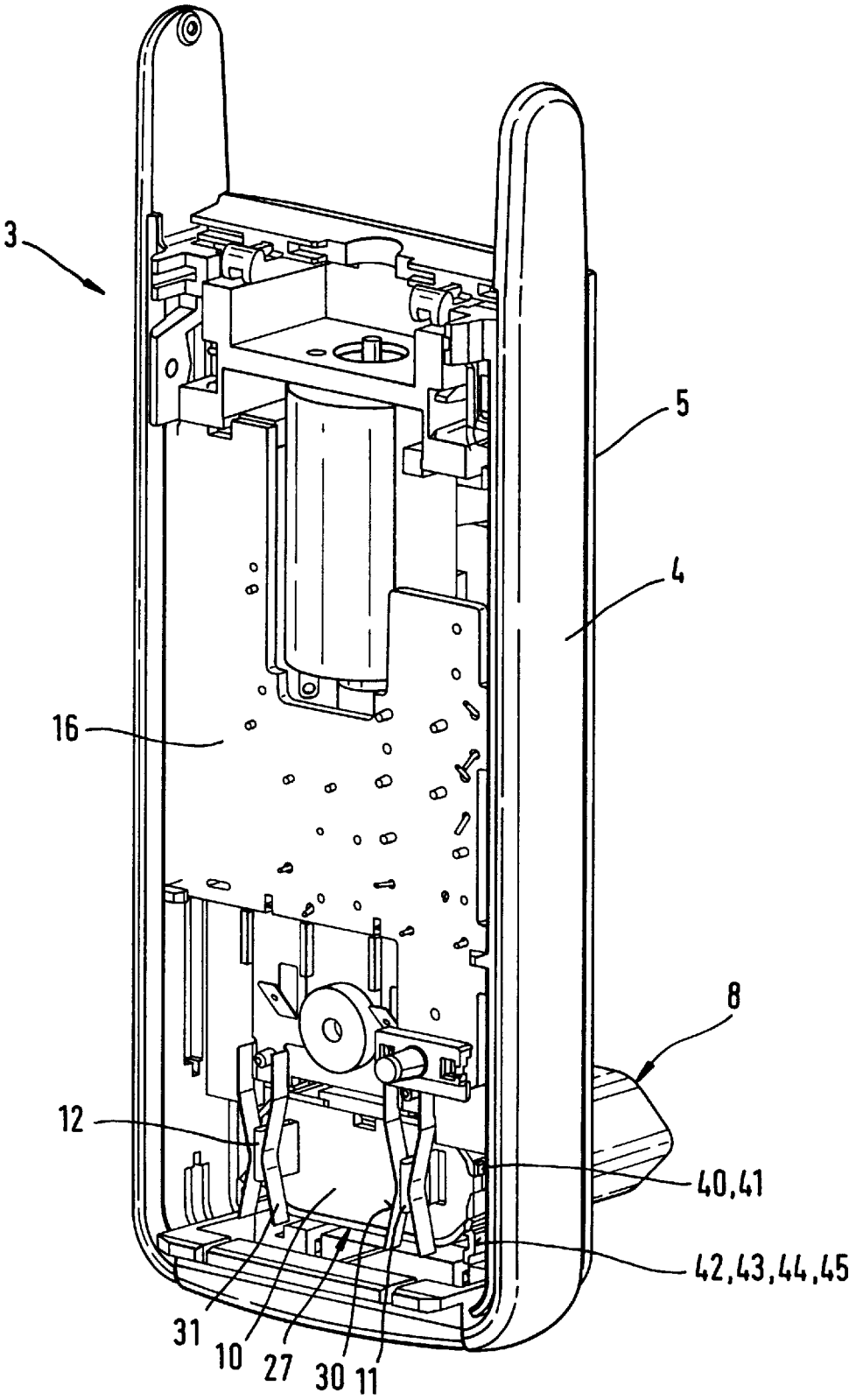
FIG. 6 is a perspective view of the housing of the dry shaving apparatus of FIG. 1 with a second housing shell removed from a U-shaped frame and with electric contact elements of the connector and the storage cell charging circuitry.
Figure 7:
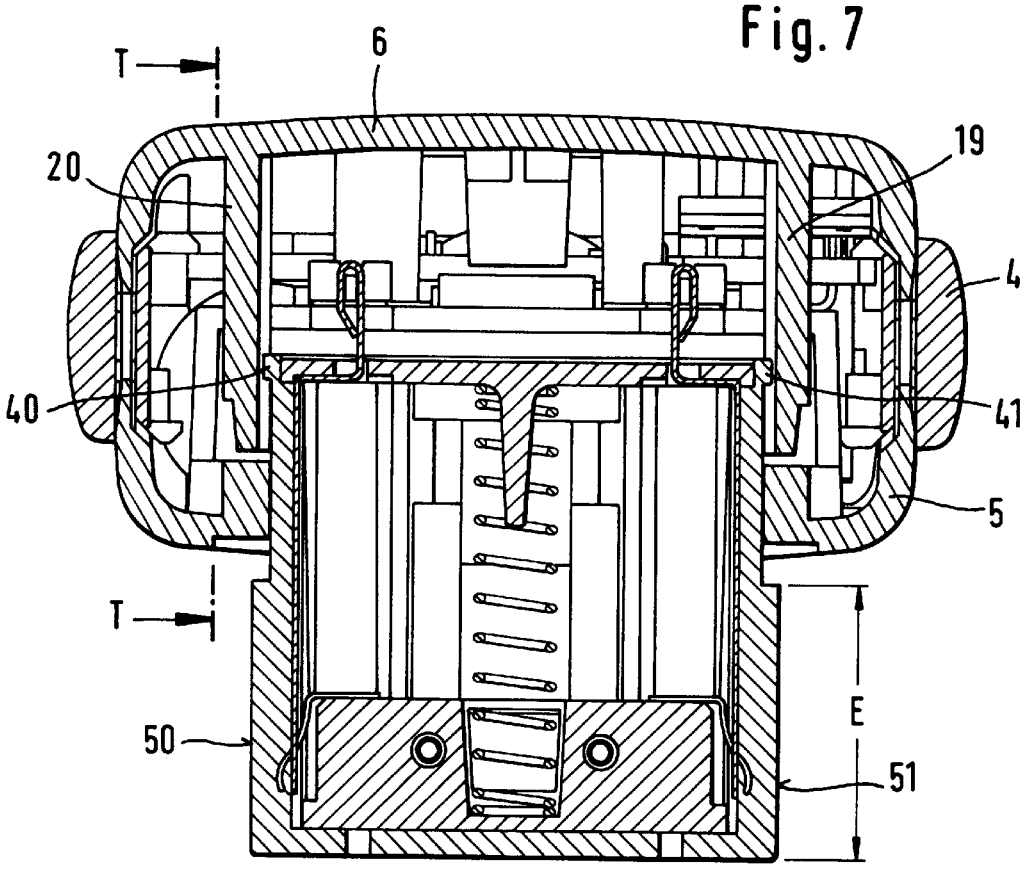
FIG. 7 is a section through the connector and the housing in the area of the locking elements for the connector in the housing.
Figure 8:
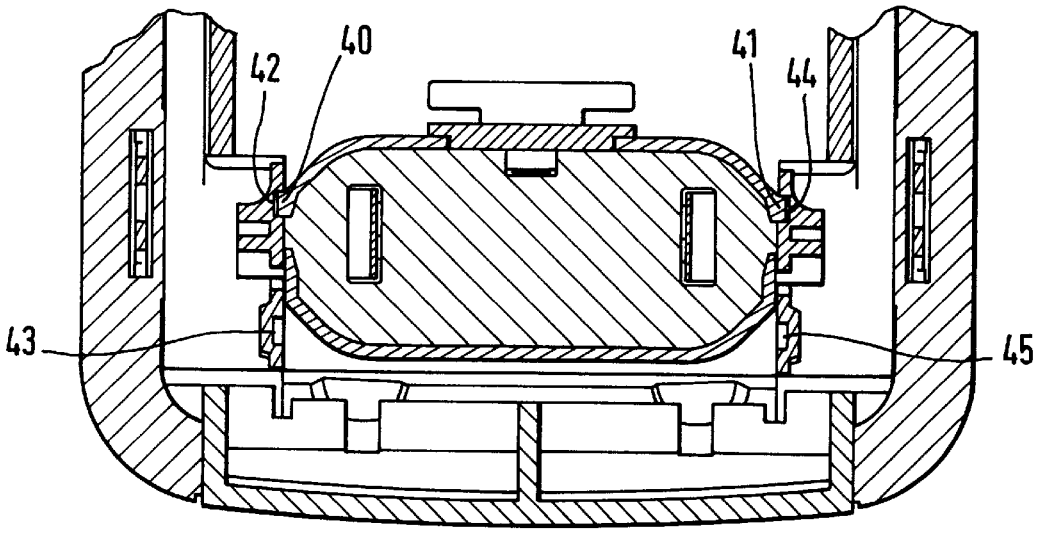
FIG. 8 is a longitudinal section through the bottom part of the housing and the connector in the area of the locking elements and the latching elements for the pivoting zone of the connector.

In the course of the connector 8 being pivoted out of the connector compartment 7 into a locking position provided essentially at right angles to the broad side B of the housing 3—see FIGS. 6, 7 and 8, the pin contacts 11 and 12 make contact with the electric contacts 30 and 31, thereby ensuring free flow of current from the connector pins 25 and 26 to the storage cell charging circuitry 15 inside the housing 3.

Figure 4:
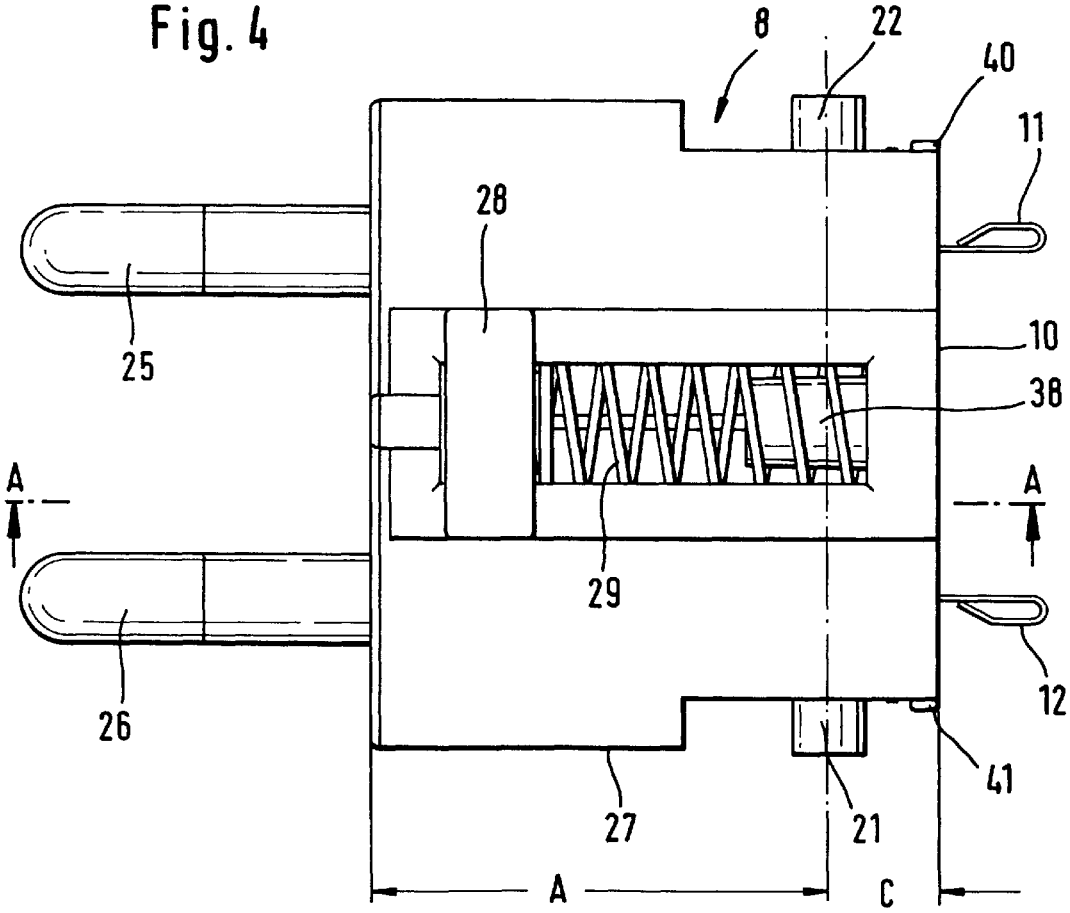
FIG. 4 is a side view of a connector with round connector pins projecting out of the connector housing and electric contacts projecting out of a rear wall.

FIG. 4 shows a side view of a connector 8 removed from the housing 3, together with connector pins 25 and 26 projecting out of the connector housing 27, pin contacts 11 and 12 and a spring 29 positioned between the rear wall 10 of the connector housing 27 and the actuating element 28. A respective bearing pin 21, 22 is formed on two opposing side walls of the connector housing 27, by means of which the connector 8 is pivotally mounted in the housing 3.

The embodiment of FIG. 4 shows furthermore the division of the connector housing 27 into three sections, namely into two outer sections, into each of which a respective one of the connector pins 25 and 26 can be moved by means of the actuating element 28, and a third section located between the connector pins 25 and 26 in which the actuating element 28 and the spring 29 are arranged. A spring guide pin 38, for example, is formed on the rear wall 10 of the connector housing 27 for improved positioning and guidance of the spring 29.

Figure 5:
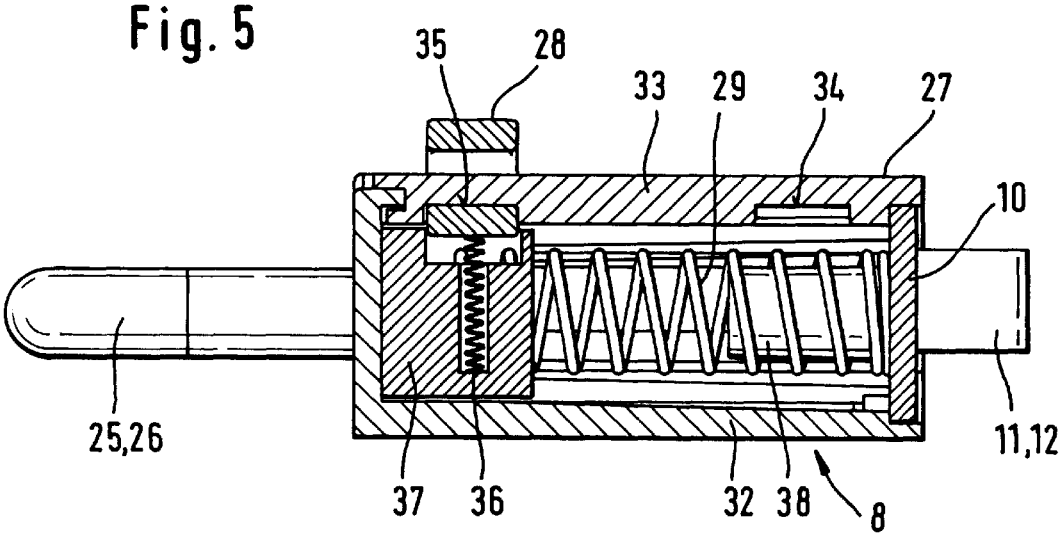
FIG. 5 is a sectional view of the connector taken along the line A—A of FIG. 4.

FIG. 5 shows a section through the connector 8 taken along the line A—A of FIG. 4. The connector housing 27 of this embodiment comprises a drawer-type bottom section 32 with an insertable and removable rear wall 10 and a mountable cover wall 33 in which two locking positions 34 and 35, for example, are formed for locking engagement of the actuating element 28. The connector pins 25 and 26 are fixedly connected to a connector pin pusher 37. The connector pin pusher 37 is coupled with the actuating element 28, and a bias spring 36 disposed between the connector pin pusher 37 and the actuating element 28 urges the actuating element 28 away from the connector pin pusher 37 in order to lock the actuating element in a respective one of the locking positions 34 or 35 formed by recesses in the cover wall 33. Between the rear wall 10 and the connector pin pusher 37 is a spring 29 which, when the actuating element 28 is disengaged from its locking position 34 in the recess, moves the connector pin pusher 37 and hence the connector pins 25, 26 fixedly connected therewith out of the connector housing 27 until the actuating element 28, under the action of the spring 36, snaps into the recess forming the second locking position 35. The locking of the connector pins 25, 26 via the connector pin pusher 37 and the latching of the actuating element 28 in the recess forming the locking position 35 ensure a secure hold for the connector pins 25 and 26 outside the connector housing 27 and hence safe insertion of the connector pins 25 and 26 in mating openings of a live socket-outlet—not shown.

FIG. 6 is a perspective view of the housing 3 showing the second housing shell 6 removed from the U-shaped frame 4—see FIG. 3—and a connector 8 projecting out of the first housing shell 5. The rear of the printed-circuit board 16 equipped with a storage cell charging circuitry, including the electric contacts 30 and 31, is visible through the opened housing 3. The electric contacts 30 and 31 are in contact with the pin contacts 11 and 12 of the connector 8 projecting out of the rear wall 10 of the connector housing 27. Locking elements 40 and 41 are integrally formed on both narrow sides of the connector housing 27 adjacent to the two bearing pins 21, 22—see FIG. 4—and, when the connector 8 is in its respective end position—one being illustrated in FIG. 1 and the other in FIG. 3—latch in corresponding recesses 42, 43, 44, 45 in order to lock the connector 8 either inside the connector compartment 7 or in a position in which the connector is pivoted out of the connector compartment 7. Further details of this locking arrangement for the connector 8 will become apparent from FIGS. 7 and 8.

FIG. 7 shows a cross section through the connector 8 and the locking elements 40 and 41 integrally formed thereon as well as through the U-shaped frame 4 with the first housing shell 5 and the second housing shell 6 connected to the frame. Two front bearing arms 19 and 20 having groove-type recesses 42, 43, 44 and 45 are formed on the second housing shell 6—see FIG. 8. The spacing of the recesses 42 and 43 in the rear bearing arm 20 and the spacing of the recesses 44 and 45 in the rear bearing arm 19 is selected so that the locking elements 40 and 41 are moved out of the recesses 42 and 44 and engaged in the recesses 43 and 45 when the connector 8 is pivoted around the bearing pins 21 and 22, while they are moved out of the recesses 43 and 45 and engage into the recesses 42 and 44 when the connector is pivoted in reverse direction in order to secure the connector 8 in each of the illustrated latching positions.

Figure 10:
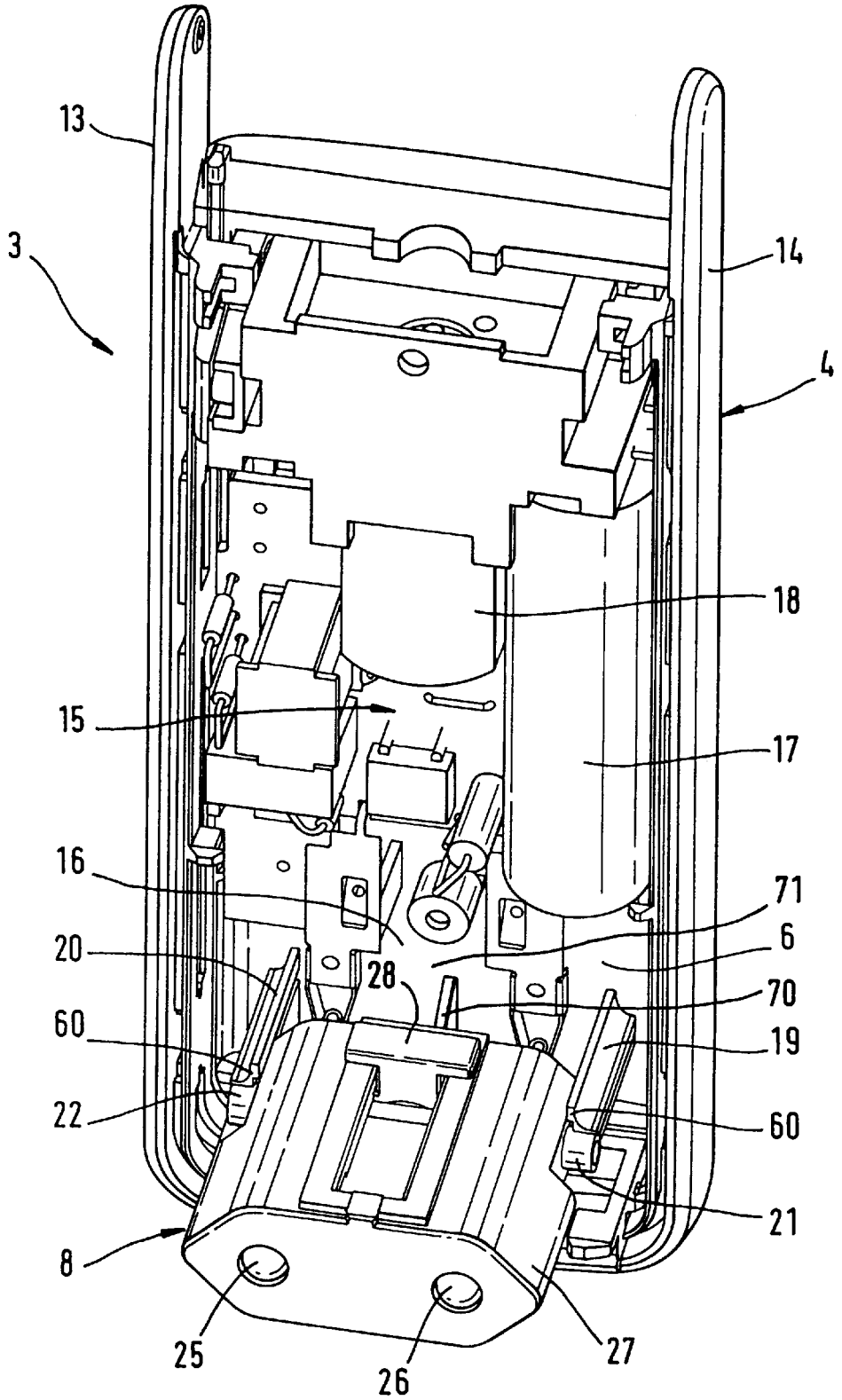
FIG. 10 is a perspective view of the housing of a dry shaving apparatus of FIG. 1 with an unlocking element for the actuating element.
Figure 11:
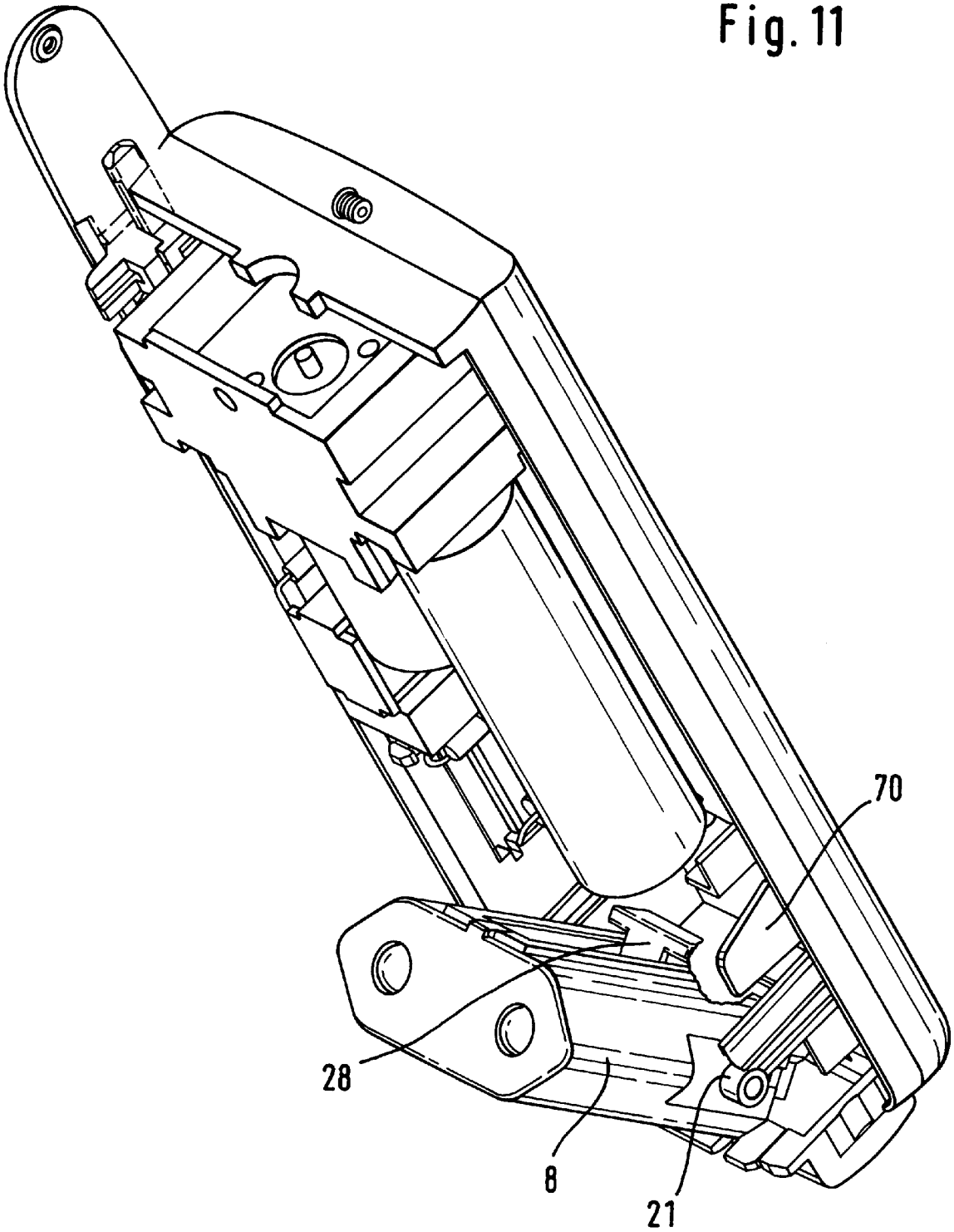
FIG. 11 is a perspective view of the housing of a dry shaving apparatus of FIGS. 1 and 2 with a pivotally mounted connector and an unlocking element.

FIG. 10 shows a further perspective view of the housing 3 of FIG. 2, which apart from the unlocking element 70 provided on the back compartment wall portion 71 is identical with the representation of FIG. 2. The unlocking element 70 is constructed as a partially round ledge projecting from the back compartment wall portion 71 or from a printed-circuit board—see FIG. 11. The rounded shape of the ledge facilitates its interaction with the actuating element 28 to be unlocked while the connector 8 is pivoted into the interior of the connector compartment 7. The bearing pins 21, 22 of the connector housing 27 are set a distance A from the front wall 73 and a distance C from the end wall 10—see FIG. 4, as a result of which the connector housing 27 is pivoted out of the connector compartment 7 by exerting an actuating pressure on the housing surface formed by the distance C. The actuating element 28, unlocked by means of the unlocking element 70 when the connector housing 27 is pivoted into the interior of the connector compartment 7, ensures that the pressure of the compressed spring 29 is transmitted to the connector pins 25, 26, holding the connector pins 25, 26 against the upper compartment wall portion 72 of the connector compartment 7. While the connector 8 is pivoted out of the connector compartment 7, the connector pins 25, 26 slide along the upper compartment wall portion 72 until they are released and, after being released, are abruptly moved under the action of the spring 29 into the second locking position 35 which serves simultaneously as operating position.

The narrow sides 50, 51 of the housing of the connector 8 are of a wedge-shaped configuration at least in a section E projecting beyond the outer contour of the housing 3—see FIGS. 1, 3 and 7. This shape serves to provide a better hold for a connector equipped with round connector pins and for the electric appliance connected with it within a live socket-outlet, which is provided with holding elements at least partly conformed to the outer contour of the connector—not shown.

What is claimed is:

1. A rechargeable, hand-held electrical appliance, having an appliance housing to accommodate at least one rechargeable storage cell, the appliance housing having two opposing broad sides and two opposing narrow sides and a base, one of the broad sides defining an opening to a connector compartment in which a connector equipped with connector pins is pivotally mounted so as to define a pivotal axis that is substantially parallel to the broad sides, wherein the connector pins are movably carried in a connector housing surrounding the connector pins, said connector pins translating along an extension axis which is substantially perpendicular to said pivotal axis, wherein the connector housing is arranged for movement about the pivotal axis out of and into the connector compartment, the connector being oriented so that the connector pins remain substantially equidistant from the base while pivoting, and wherein, with the connector in a position in which it is pivoted out of one of the broad sides of the appliance housing the connector pins are movable out of and into the connector housing in response to the motion of an actuating element that is slidably connected to an inward-facing side of the connector housing, said connector pins translating out of said connector housing while said connector housing pivots out of said appliance housing.

2. The electric appliance as claimed in claim 1, characterized in that provision is made inside the connector housing for at least one locking position for the connector pins.

3. The electric appliance as claimed in claim 2, characterized in that the connector pins are held inside the connector housing in a locking position.

4. The electric appliance as claimed in claim 2, characterized in that the connector pins are held outside the connector housing in a locking position.

5. The electric appliance as claimed in claim 4, characterized in that said appliance includes at least one spring, and the connector pins are adapted to be acted upon by said at least one spring.

6. The electric appliance as claimed in claim 5, characterized in that the spring is arranged between a rear wall of the connector housing and a connector pin pusher fixedly connected to the connector pins.

7. The electric appliance as claimed in claim 5, characterized in that the connector pin pusher is movable from a retracted locking position into an extended locking position and back again in response to the movement of the actuating element.

8. The electric appliance as claimed in claim 7, characterized in that the actuating element is capable of being held in the retracted and extended locking positions by a bias spring.

9. The electric appliance as claimed in claim 1, characterized in that the connector housing is equipped with at least one locking element, and that for each locking element two latching elements are provided on the appliance housing in order to limit the pivoting movement of the connector out of and into the appliance housing.

10. The electric appliance as claimed in claim 1, characterized in that the connector is pivotally mounted in the connector compartment on two bearing pins.

11. The electric appliance as claimed in claim 10, characterized in that the pivot bearing for the bearing pins is formed by corresponding semi-circular recesses in a first and a second shell of the appliance housing.

12. The electric appliance as claimed in claim 10 or claim 11, characterized in that each of the two bearing pins are positioned a distance from each end wall of the connector.

13. The electric appliance as claimed in claim 1, characterized in that each connector pin is connectable to an electric contact of the storage cell charging circuitry via an electric contact while the connector is pivoted out of the connector compartment.

14. The electric appliance as claimed in claim 1, characterized in that the connector pins are of a round configuration.

15. The electric appliance as claimed in claim 1, characterized in that the connector pins are of a leaf-shaped configuration.

16. The electric appliance as claimed in claim 8, characterized in that the actuating element, when in the retracted locking position, is movable against an unlocking element provided in the appliance housing.

17. The electric appliance as claimed in claim 16, characterized in that the connector pins are capable of being unlocked by the unlocking element acting on the actuating element when the connector housing is pivoted into the interior of the connector compartment.

18. The electric appliance as claimed in claim 17, characterized in that the connector pins are held by the spring in abutting engagement with a compartment wall of the connector compartment.

19. The electric appliance as claimed in claim 18, characterized in that the unlocked connector pins are moved by the spring automatically out of the connector housing into an extended locking position when the connector is pivoted into its operating position.

20. The electric appliance as claimed in claim 19, characterized in that the unlocking element is positioned on the compartment wall of the appliance housing.

21. The electric appliance as claimed in claim 16, characterized in that the unlocking element is positioned on a printed-circuit board in the appliance housing.

22. The electric appliance as claimed in claim 16, characterized in that the unlocking element is configured as a protruding, rounded ledge.

* * * * *